US009493222B1

(12) United States Patent
Chapman et al.

(10) Patent No.: US 9,493,222 B1
(45) Date of Patent: Nov. 15, 2016

(54) MARINE VESSELS AND PROPULSION SYSTEMS FOR MARINE VESSELS HAVING STEERABLE PROPULSION DEVICES MOUNTED ON OUTWARDLY ANGLED TRANSOM PORTIONS

(71) Applicant: Brunswick Corporation, Lake Forest, IL (US)

(72) Inventors: Christopher R. Chapman, Fond du Lac, WI (US); Donald F. Mason, Jr., Fort Wayne, IN (US); Brad E. Taylor, Guthrie, OK (US); David Bell, Plymouth, MI (US); Daniel E. Clarkson, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 143 days.

(21) Appl. No.: 14/538,319

(22) Filed: Nov. 11, 2014

(51) Int. Cl.

| | |
|---|---|
| ***B63H 20/12*** | (2006.01) |
| ***B63H 25/42*** | (2006.01) |
| ***B63B 1/12*** | (2006.01) |
| ***B63B 35/34*** | (2006.01) |
| *B63H 20/00* | (2006.01) |

(52) U.S. Cl.
CPC ..... *B63H 25/42* (2013.01); *B63B 1/121* (2013.01); *B63B 35/34* (2013.01); *B63H 20/12* (2013.01); *B63H 2020/003* (2013.01)

(58) Field of Classification Search
CPC B63H 2020/003; B63H 20/08; B63H 20/12; B63H 21/265; B63H 25/42; B63B 2241/22
See application file for complete search history.

(56) References Cited

U.S. PATENT DOCUMENTS

| | | | |
|---|---|---|---|
| 906,901 | A | 12/1908 | Lane et al. |
| 1,355,513 | A | 10/1920 | Simpson et al. |
| 4,040,379 | A | 8/1977 | Betts |
| 6,234,853 | B1 | 5/2001 | Lanyi et al. |
| 6,273,771 | B1 | 8/2001 | Buckley et al. |
| 6,322,406 | B1 | 11/2001 | Griffith, Sr. et al. |

(Continued)

FOREIGN PATENT DOCUMENTS

| | | |
|---|---|---|
| DE | 2 207 604 | 2/1972 |
| DE | 23 56 508 | 11/1973 |

OTHER PUBLICATIONS

"Transom Angle", http://www.boatdesign.net/forums/boat-design/transom-angle-34448.html, published Sep. 2, 2010, retreived May 31, 2016.*

*Primary Examiner* — Andrew Polay
(74) *Attorney, Agent, or Firm* — Andrus Intellectual Property Law, LLP

(57) ABSTRACT

A marine vessel comprises an elongated hull that extends along a center axis from an aftward end to a forward end. A first transom portion and a second transom portion are located closer to the aftward end than the forward end. A first propulsion device is connected to the first transom portion and steerable about a first steering axis. A second propulsion device is connected to the second transom portion and steerable about a second steering axis. The first and second transom portions each has a mounting face that is set at a non-perpendicular outboard angle to the center axis. A controller is configured to steer the first and second propulsion devices inwardly towards a center of pressure of the marine vessel so that during certain lateral translations of the marine vessel the first and second propulsion devices can provide thrusts along axes that intersect aftwardly of the center of pressure.

18 Claims, 7 Drawing Sheets

(56) References Cited

U.S. PATENT DOCUMENTS

| | | | | |
|---|---|---|---|---|
| 7,033,234 | B2 | 4/2006 | Arvidsson et al. | |
| 7,267,068 | B2 | 9/2007 | Bradley et al. | |
| 7,305,928 | B2 | 12/2007 | Bradley et al. | |
| 7,467,595 | B1 | 12/2008 | Lanyi et al. | |
| 8,622,777 | B1 | 1/2014 | McNalley et al. | |
| 8,777,681 | B1 | 7/2014 | McNalley et al. | |
| 2016/0114875 | A1* | 4/2016 | Wong | B63H 25/42 440/55 |

* cited by examiner

MARINE VESSELS AND PROPULSION SYSTEMS FOR MARINE VESSELS HAVING STEERABLE PROPULSION DEVICES MOUNTED ON OUTWARDLY ANGLED TRANSOM PORTIONS

FIELD

The present disclosure relates to marine vessels and propulsion systems for marine vessels.

BACKGROUND

The following are incorporated herein by reference:

U.S. Pat. No. 6,273,771 discloses a control system for a marine vessel that incorporates a marine propulsion system that can be attached to a marine vessel and connected in signal communication with a serial communication bus and a controller. A plurality of input devices and output devices are also connected in signal communication with the communication bus. A bus access manager, such as a CAN Kingdom network, is connected in signal communication with the controller to regulate the incorporation of additional devices to the plurality of devices in signal communication with the bus. The controller is connected in signal communication with each of the plurality of devices on the communication bus. The input and output devices can each transmit messages to the serial communication bus for receipt by other devices.

U.S. Pat. Nos. 6,234,853 and 7,467,595 discloses a docking system which utilizes the marine propulsion unit of a marine vessel, under the control of an engine control unit that receives command signals from a joystick or push button device, to respond to a maneuver command from the marine operator. The docking system does not require additional propulsion devices other than those normally used to operate the marine vessel under normal conditions. The docking or maneuvering system of uses two marine propulsion units to respond to an operator's command signal and allows the operator to select forward or reverse commands in combination with clockwise or counterclockwise rotational commands either in combination with each other or alone.

U.S. Pat. No. 7,267,068 discloses a marine vessel that is maneuvered by independently rotating first and second marine propulsion devices about their respective steering axes in response to commands received from a manually operable control device, such as a joystick. The marine propulsion devices are aligned with their thrust vectors intersecting at a point on a centerline of the marine vessel and, when no rotational movement is commanded, at the center of gravity of the marine vessel. Internal combustion engines are provided to drive the marine propulsion devices. The steering axes of the two marine propulsion devices are generally vertical and parallel to each other. The two steering axes extend through a bottom surface of the hull of the marine vessel.

U.S. Pat. No. 7,305,928 discloses a vessel positioning system that maneuvers a marine vessel in such a way that the vessel maintains its global position and heading in accordance with a desired position and heading selected by the operator of the marine vessel. When used in conjunction with a joystick, the operator of the marine vessel can place the system in a station keeping enabled mode and the system then maintains the desired position obtained upon the initial change in the joystick from an active mode to an inactive mode. In this way, the operator can selectively maneuver the marine vessel manually and, when the joystick is released, the vessel will maintain the position in which it was at the instant the operator stopped maneuvering it with the joystick.

U.S. Pat. No. 7,467,595 discloses a method for controlling the movement of a marine vessel which rotates one of a pair of marine propulsion devices and controls the thrust magnitudes of two marine propulsion devices. A joystick is provided to allow the operator of the marine vessel to select port-starboard, forward-reverse, and rotational direction commands that are interpreted by a controller which then changes the angular position of at least one of a pair of marine propulsion devices relative to its steering axis.

U.S. Pat. No. 8,622,777 discloses systems and methods for maneuvering a marine vessel that limit interference by the hull of the vessel with reverse thrust. A marine propulsion device provides at least a reverse thrust with respect to the marine vessel. The propulsion device is vertically pivotable into a trim position wherein the hull does not impede or interfere with the reverse thrust. A control circuit controls the propulsion device to move into the trim position when the reverse thrust of the propulsion device is requested.

U.S. Pat. No. 8,777,681 discloses systems for maneuvering a marine vessel comprising a plurality of marine propulsion devices that are movable between an aligned position to achieve of movement of the marine vessel in a longitudinal direction and/or rotation of the marine vessel with respect to the longitudinal direction and an unaligned position to achieve transverse movement of the marine vessel with respect to the longitudinal direction. A controller has a programmable circuit and controls the plurality of marine propulsion devices to move into the unaligned position when a transverse movement of the marine vessel is requested and to thereafter remain in the unaligned position after the transverse movement is achieved. Methods of maneuvering a marine vessel comprise requesting transverse movement of the marine vessel with respect to a longitudinal direction and operating a controller to orient a plurality of marine propulsion devices into an unaligned position to achieve the transverse movement, wherein the plurality of marine propulsion devices remain in the unaligned position after the transverse movement is achieved.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In certain examples disclosed herein, a marine vessel comprises an elongated hull that extends along a center axis from an aftward end to a forward end. A first transom portion and a second transom portion each are located closer to the aftward end than the forward end. A first propulsion device is connected to the first transom portion and steerable about a first steering axis. A second propulsion device is connected to the second transom portion and steerable about a second steering axis. The first and second transom portions each have a mounting face that is set at a non-perpendicular outboard angle to the center axis. A controller is configured to steer the first and second propulsion devices inwardly (forward portion of marine propulsion devices pointing to the center of the marine vessel) towards a center of pressure of the marine vessel so that during certain lateral translations of the marine vessel the first and second propulsion devices can provide thrusts along axes that intersect aftwardly of the center of pressure. In certain non-limiting examples, the marine vessel is a pontoon boat.

BRIEF DESCRIPTION OF THE DRAWINGS

Marine vessels and propulsion systems for marine vessels are described with reference to the following drawing figures. The same numbers are used throughout the drawing figures to reference like features and components.

DETAILED DESCRIPTION OF THE DRAWINGS

Figure 1:
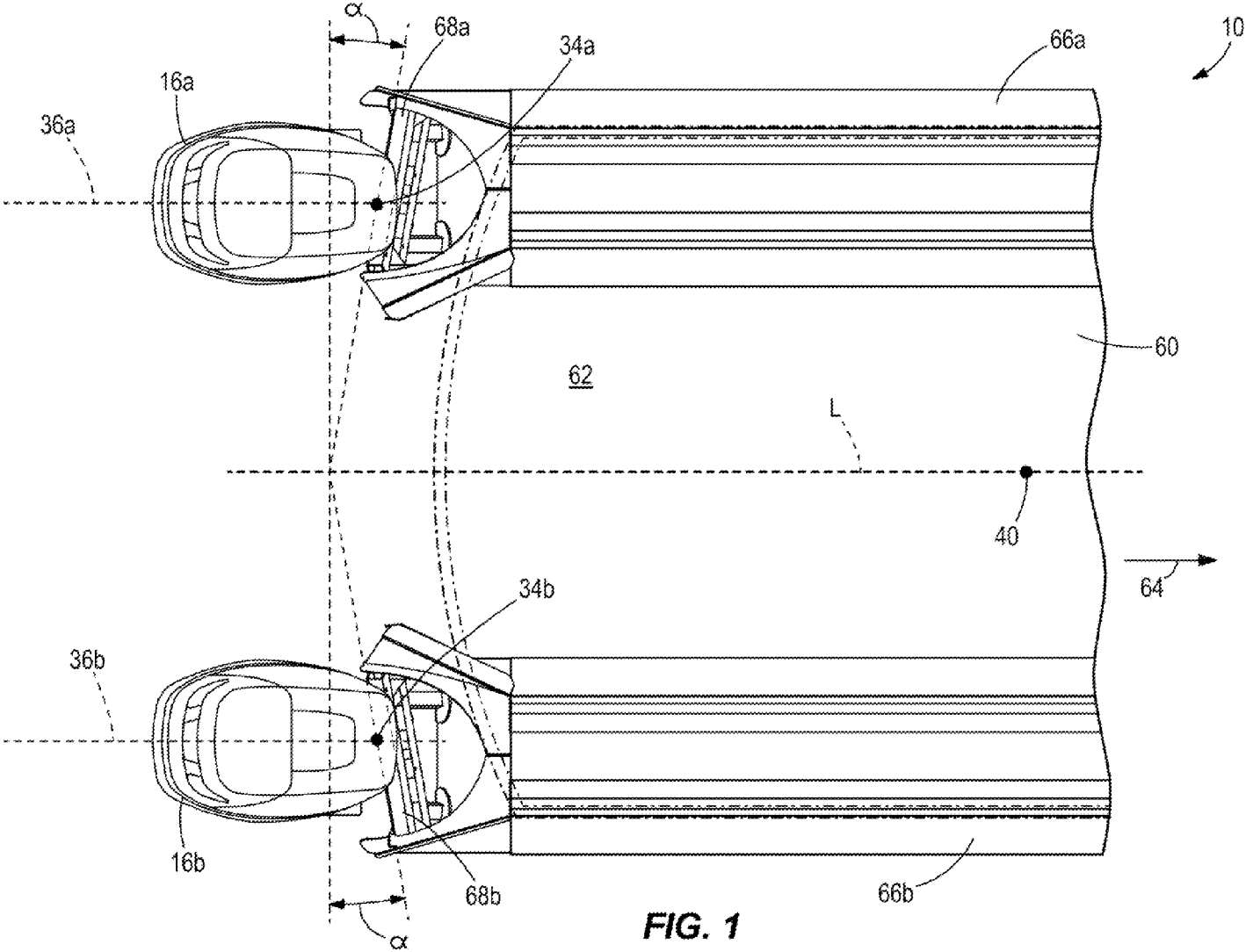
FIG. 1 is a schematic view of a marine vessel having a first and second marine propulsion devices that are oriented in an aligned, parallel position.

FIGS. 1-10 depict components of a marine vessel 10 and a system 12 for maneuvering and orienting the marine vessel 10. The system 12 includes among other things a controller 14 (see FIG. 10) for controlling the rotational position and operation of a plurality of marine propulsion devices 16*a*, 16*b* based upon inputs from an input device. It should be understood that the particular configurations of the marine vessel 10 and system 12 are merely exemplary. It is possible to apply the concepts that are provided in the present disclosure to substantially different marine vessels and to substantially different configurations for systems for maneuvering and orienting marine vessels.

For example, the marine vessel 10 shown in the drawings is a pontoon boat; however many of the concepts disclosed herein are applicable to marine vessels other than pontoon boats. Also, the controller 14 is shown in schematic form and has a plurality of command control sections 18*a*, 18*b* located at a helm 20 of the marine vessel 10 that communicate with engine control sections 22*a*, 22*b* associated with each marine propulsion device 16*a*, 16*b*, steering control sections 24*a*, 24*b* associated with steering actuators 26*a*, 26*b* for steering the marine propulsion devices 16*a*, 16*b*, and trim control sections 23*a*, 23*b* associated with trim actuators 25*a*, 25*b* for changing trim of the marine propulsion devices 16*a* 16*b*. However, the controller 14 can have any number of sections (including for example one section) and can be located remotely from or at different locations in the vessel 10 from that shown. It should also be understood that the concepts disclosed in the present disclosure are capable of being implemented with different types of control systems including systems that acquire global position data and real time positioning data, such as for example global positioning systems, inertial measurement units, and the like.

Further, certain types of input devices such a joystick 28, a steering wheel 30 and shift/throttle lever 32, keypad 33 and touch screen 35 are herein described. It should be understood that the present disclosure is applicable with other types of input devices such as video screens, touch pads, voice command modules, and the like. It should also be understood that the concepts disclosed in the present disclosure are able to function in a preprogrammed format without user input or in conjunction with different types of input devices, as would be known to one having ordinary skill in the art. Further equivalents, alternatives and modifications are also possible as would be recognized by one having ordinary skill in the art.

Further, a marine vessel 10 having two (i.e. first and second) marine propulsion devices 16*a*, 16*b* is described, however the concepts in the present disclosure are applicable to marine vessels having more than two marine propulsion devices. The concepts in the present disclosure are also applicable to marine vessels having any type or configuration of propulsion device, such as for example electric motors, internal combustion engines, and/or hybrid systems configured as an inboard drives, outboard drives, inboard/outboard drives, stern drives, and/or the like. The propulsion devices could include propellers, impellers, pod drives, and/or the like.

Figure 2:
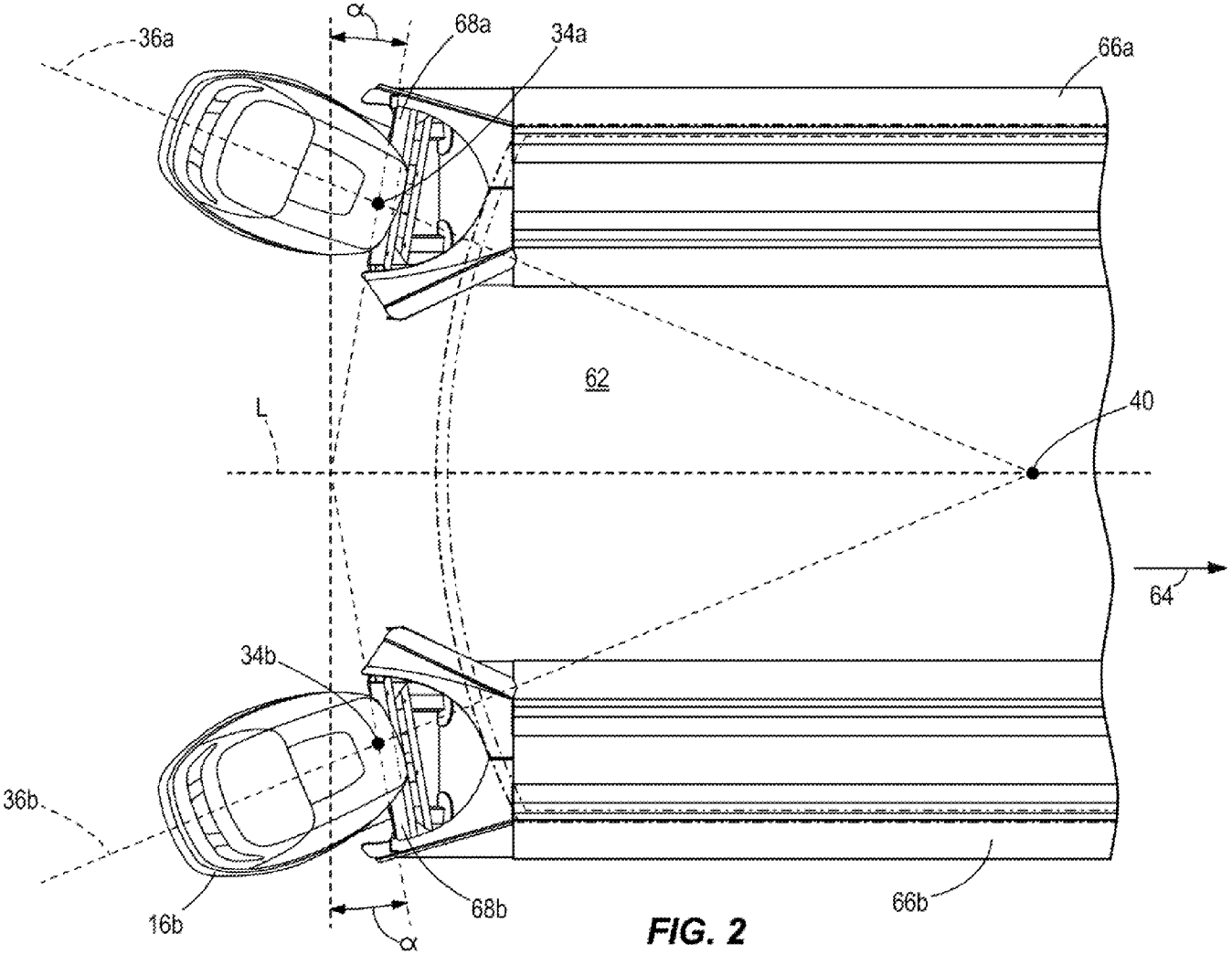
FIG. 2 is a schematic depiction like FIG. 1, wherein the first and second marine propulsion devices are oriented in an unaligned, non-parallel position.
Figure 3:
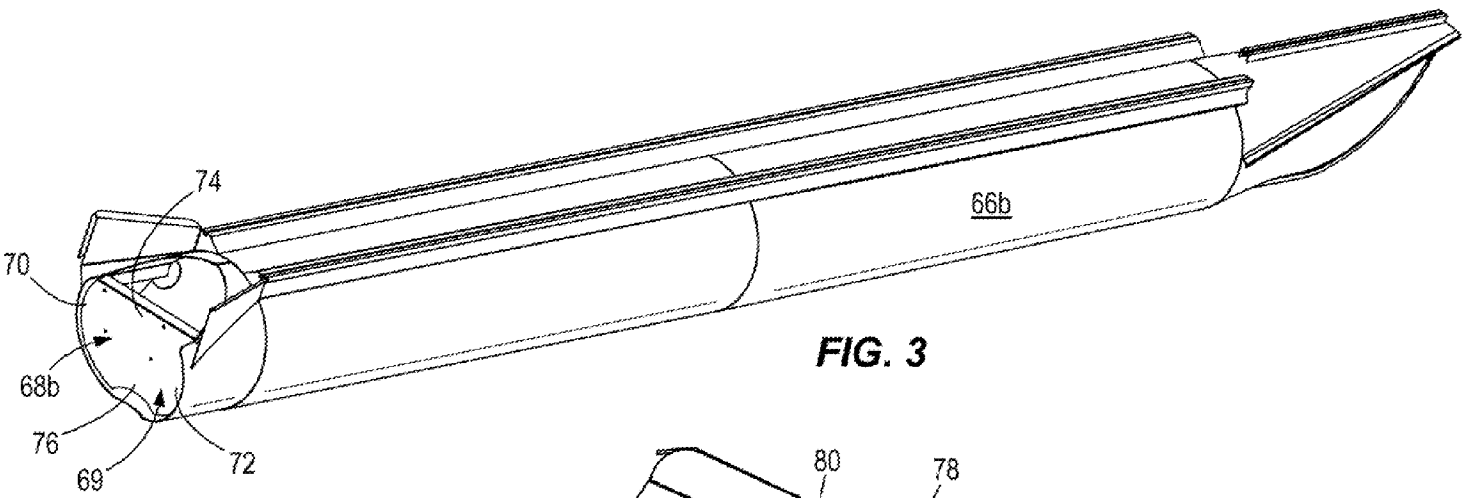
FIG. 3 is a perspective view of a starboard pontoon from the marine vessel.

Now referring to FIGS. 1 and 2, a marine vessel 10 is schematically illustrated and has first and second marine propulsion devices 16*a*, 16*b*, which in the example shown are outboard internal combustion engines. The marine propulsion devices 16*a*, 16*b* are each rotatable in clockwise and counterclockwise directions through a substantially similar range of rotation about respective first and second steering axes 34*a*, 34*b*. Rotation of the marine propulsion devices 16*a*, 16*b* is facilitated by electro-hydraulic steering actuators 26*a*, 26*b* (see FIG. 10). Steering actuators for rotating marine propulsion devices are well known in the art, examples of which are provided in the incorporated U.S. Pat. No. 7,467,595. Each marine propulsion device 16*a*, 16*b* creates thrust in either a forward or backward direction along a respective propulsion axis 36*a*, 36*b*. The direction of the propulsion axes 36*a*, 36*b* will vary depending upon the direction of steering.

As shown in FIG. 1, the propulsion devices 16*a*, 16*b* are aligned with each other and with respect to a longitudinal centerline L (i.e. center axis) of the marine vessel 10, so as to define thrust vectors extending along propulsion axes 36*a*, 36*b* that are parallel to the longitudinal centerline L. The particular orientation shown in FIG. 1 is typically employed to achieve either a forward or backward movement of the marine vessel 10 or a rotational movement of the marine vessel 10. Specifically, application of both thrust vectors forwardly causes the marine vessel 10 to move forward. Conversely, application of thrust vectors rearwardly causes the marine vessel 10 to move rearwardly. Further, opposite application of respective thrust vectors (i.e. one forwardly and one rearwardly) causes rotation of the marine vessel 10 about a center of turn 40 for the marine vessel 10. In this example, forward application of thrust from propulsion device 16*a* and rearward application of thrust from propulsion device 16*b* causes clockwise rotation of the marine vessel 10 about the center of turn 40 of the marine vessel 10, whereas rearward application of thrust from propulsion device 16*a* and forward application of thrust from propulsion device 16*b* causes counter-clockwise rotation of marine vessel 10 about the center of turn 40. Various other maneuvering strategies and mechanisms are described in the incorporated U.S. Pat. Nos. 6,234,853; 7,267,068; and 7,467,595.

In this example, the center of turn 40 represents an effective center of gravity for the marine vessel 10. It will be understood by those having ordinary skill in the art that the location of the center of turn 40 is not, in all cases, the actual center of gravity of the marine vessel 10. That is, the center of turn 40 can be located at a different location than the actual center of gravity that would be calculated by analyzing the weight distribution of the various components of the marine vessel. Maneuvering a marine vessel 10 in a body of water results in reactive forces exerted against the hull of the marine vessel 10 by the wind and the water. For example, as various maneuvering thrusts are exerted by the first and second marine propulsion devices 16*a*, 16*b* the hull of the vessel 10 pushes against the water and the water exerts a reaction force against the hull. As a result, the center of turn identified as point 40 in FIGS. 1 and 2 can change in response to different sets of forces and reactions exerted on the hull of the marine vessel 10. This concept is recognized by those skilled in the art and is referred to as the instantaneous center of turn in U.S. Pat. No. 6,234,853 and as the instantaneous center in U.S. Pat. No. 6,994,046.

As shown in FIG. 2, the marine propulsion devices 16*a*, 16*b* are rotated away from the aligned position shown in FIG. 1 so that the marine propulsion devices 16*a*, 16*b* and resultant propulsion axes 36*a*, 36*b* are not aligned (i.e. so as to produce thrust vectors along propulsion axes 36*a*, 36*b* that are not parallel to each other). In the example shown in FIG. 2, the marine propulsion devices 16*a*, 16*b* are operated so as to provide the same or different forward thrust vectors that extend along propulsion axes 36*a*, 36*b* that each intersect with each other at or forwardly or aftwardly of the center of turn 40. Steering of the marine propulsion devices 16*a*, 16*b* can be controlled such that propulsion axes 36*a*, 36*b* intersect with each other so as to achieve a transverse movement of the marine vessel 10. In FIG. 2, the propulsion axes 36*a*, 36*b* intersect at the effective center of turn 40 so as to achieve the transverse movement of the marine vessel 10. In this orientation, (without any external forces on the marine vessel 10) all movement of the marine vessel 10 would typically occur without rotation of the vessel 10 about the center of turn 40, with the movement of the vessel 10 resulting from the amounts and respective difference of the thrust vectors.

In some circumstances, external forces on the marine vessel 10 may cause the marine vessel 10 to yaw, despite intersection of the propulsion axes 36*a*, 36*b* at the center of turn 40. Thus in addition to the example shown in FIG. 2, various other unaligned positions of the marine propulsion devices 16*a*, 16*b* are possible to achieve one or both of a rotational and movement of the vessel 10 in any direction, including transversely to and along the longitudinal centerline L, in order to counteract external forces on the marine vessel 10 and maintain a desired direction of sidle movement with or without yaw. In certain other examples, the marine propulsion devices 16*a*, 16*b* do not have to be similarly oriented and/or could splay outwardly instead of inwardly to achieve desired movement of the vessel 10. As stated above, various other maneuvering strategies and mechanisms necessary to achieving same are described in the incorporated U.S. Pat. Nos. 6,234,853; 7,267,068; and 7,467,595.

Figure 10:
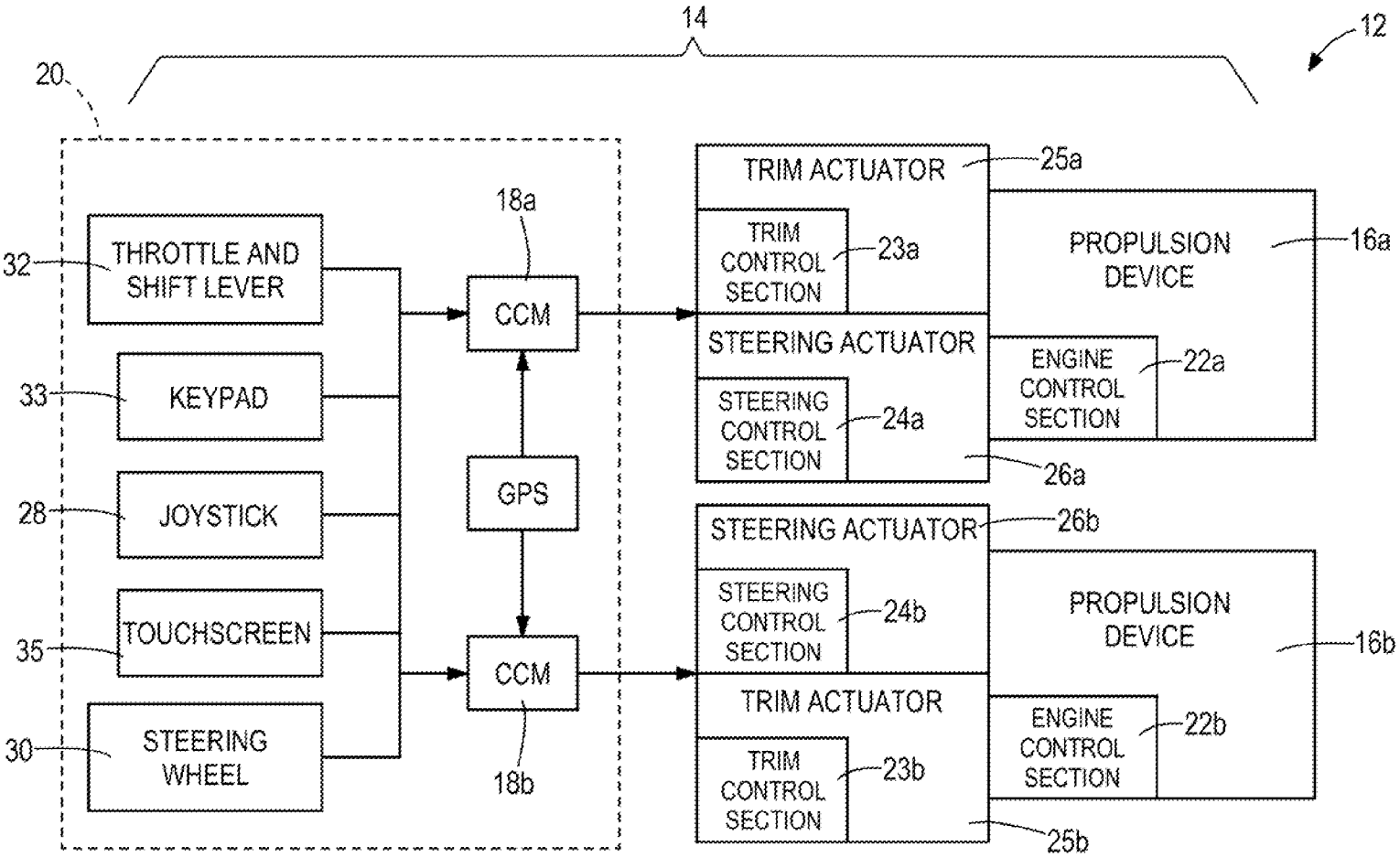
FIG. 10 is a schematic depiction of a controller for controlling the first and second marine propulsion devices.

The marine vessel 10 also includes a helm 20 (see FIG. 10) where a user can input commands for maneuvering the marine vessel 10 via one or more input devices. As discussed above, the number and type of input devices can vary from the example shown. In FIG. 10, the input devices include the joystick 28, steering wheel 30, shift/throttle lever 32, keypad 33 and touch screen 35. Rotation of the steering wheel 30 in a clockwise direction requests clockwise rotation or yaw of the marine vessel 10 about the center of turn 40. Counterclockwise rotation of the steering wheel 30 requests counterclockwise rotation or yaw of the marine vessel 10 about the center of turn 40. Forward pivoting of the shift/throttle lever 32 away from a neutral position requests forward gear and requests increased throttle. Rearward pivoting of the shift/throttle lever 32 away from a neutral position requests reverse gear and requests increasing rearward throttle.

Figure 9:
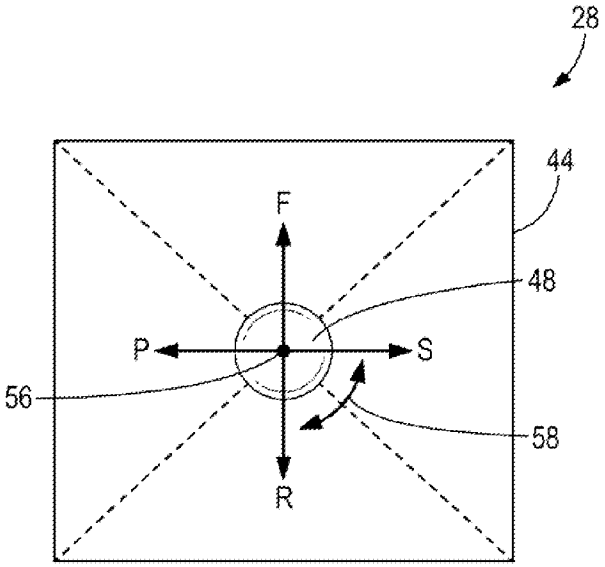
FIG. 9 is a top view of the joystick.
Figure 7:
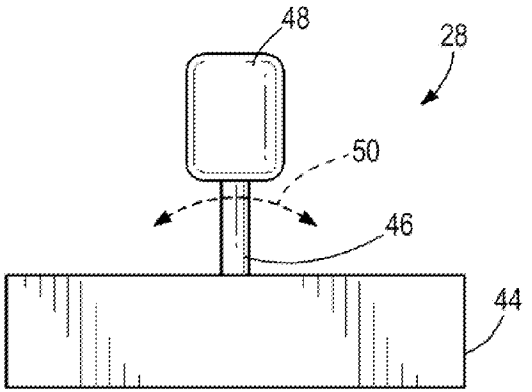
FIG. 7 is a side view of an input device in the form of a joystick.
Figure 8:
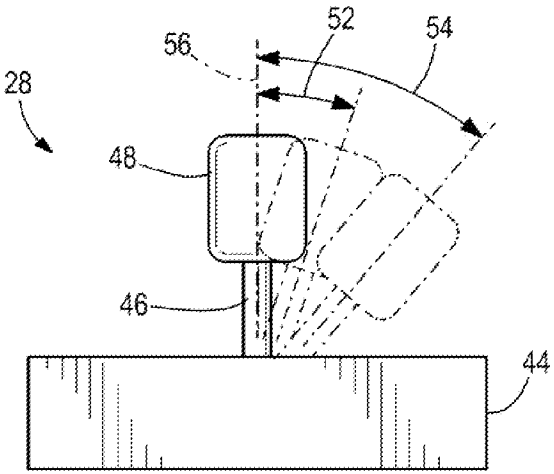
FIG. 8 is a side view showing movement of the joystick.

A simplified schematic depiction of a joystick 28 is depicted in FIGS. 7-9. The joystick 28 includes a base 44, a shaft 46 extending vertically upwardly relative to the base 44, and a handle 48 located on top of the shaft 46. The shaft 46 is movable, as represented by dashed line arrow 50 in numerous directions relative to the base 44. FIG. 8 illustrates the shaft 46 and handle 48 in three different positions which vary by the magnitude of angular movement. Arrows 52 and 54 show different magnitudes of movement. The degree and direction of movement away from the generally vertical position shown in FIG. 7 represents an analogous magnitude and direction of an actual movement command selected by a user. FIG. 9 is a top view of the joystick 28 in which the handle 48 is in a central, vertical, or neutral, position. The handle 48 can be manually manipulated in a forward F, rearward R, port P or starboard S direction to provide actual movement commands into F, R, P, S directions or any other direction therebetween. In addition, the handle 48 can be rotated about the centerline 56 of the shaft 46 as represented by arrow 58 to request rotational movement or yaw of the marine vessel 10 about the center of turn 40. Clockwise rotation of the handle 48 requests clockwise rotation of the vessel 10 about the center of turn 40, whereas counterclockwise rotation of the handle 48 requests counterclockwise rotation of the vessel about the center of turn 40. Various other joystick structures and operations are described in the incorporated U.S. Pat. Nos. 6,234,853; 7,267,068; and 7,467,595.

As depicted in FIG. 10, the various input devices communicate with a controller 14 which in the example shown is comprised of a controller area network. The controller 14 is programmed to control operation of marine propulsion devices 16*a*, 16*b*, steering actuators 26*a*, 26*b* and trim actuators 25*a*, 25*b* associated therewith. As discussed above, the controller 14 can have different forms. In the example shown, the controller 14 includes a plurality of command control sections 18*a*, 18*b* located at the helm 20. A command control section 18*a*, 18*b* is provided for each marine propulsion device 16*a*, 16*b*. The controller 14 also includes an engine control section 22*a*, 22*b* located at and controlling operation of each respective propulsion device 16*a*, 16*b*, a steering control section 24*a*, 24*b* located at and controlling operation of each steering actuator 26*a*, 26*b* and a trim control section 23*a*, 23*b* located at and controlling operation of each trim actuator 25*a*, 25*b*. Each control section has a memory and processor for sending and receiving electronic control signals, for communicating with other controllers in the controller area network, and for controlling operations of certain components in the system 12 such as the operation and positioning of engine marine propulsion devices 16*a*, 16*b* and related steering actuators 26*a*, 26*b* and trim actuators 25*a*, 25*b*. Examples of the programming and operations of the controller 14 and its sections are described in further detail below with respect to non-limiting examples and/or algorithms. While each of these examples/algorithms includes a specific series of steps for accomplishing certain system control functions, the scope of this disclosure is not intended to be bound by the literal order or literal content of steps described herein, and non-substantial differences or changes still fall within the scope of the disclosure.

In the example shown, each command control section 18*a*, 18*b* receives user inputs via the controller 14 from the joystick 28, steering wheel 30, shift/throttle lever 32, etc. Each command control section 18*a*, 18*b* is programmed to convert the user inputs into electronic commands and then send the commands to other controller sections in the system 12, including the engine control sections 22*a*, 22*b*, the steering control sections 24*a*, 24*b*, and the trim control sections 23*a*, 23*b*. For example, when the shift/throttle lever 32 is actuated, as described above, each command control section 18*a*, 18*b* sends commands to the respective engine control sections 22*a*, 22*b* to achieve the requested change in throttle and/or shift. Further, when the steering wheel 30 is actuated, as described above, each command control section 18*a*, 18*b* sends commands to the respective steering control sections 24*a*, 24*b* to achieve the requested change in steering. When the joystick 28 is moved out of its vertical position, each command control section 18*a*, 18*b* sends commands to the respective engine control section 22*a*, 22*b* and/or steering control section 24*a*, 24*b* to achieve a movement commensurate with the movement of the joystick 28. When the handle 48 of the joystick 28 is rotated, each command control section 18*a*, 18*b* sends commands to the respective engine control section 22*a*, 22*b* and/or steering control section 24*a*, 24*b* to achieve the requested vessel yaw or rotation. Other examples of communication between input devices and a controller area network are conventional and well understood in the art.

In certain examples, the controller 14 can be configured such that movement of the joystick 28 out of its vertical position can effectively engages a "joystick mode" wherein the controller 14 controls operation and positioning of the marine propulsion devices 16*a*, 16*b* based upon movement of the joystick 28. As explained herein above, each respective propulsion device 16*a*, 16*b* can move into and out of the aligned position shown in FIG. 1 when the joystick 28 is moved out of its vertical position. In this example, the controller 14 controls the plurality of marine propulsion devices 16*a*, 16*b* to move into an unaligned position, such as for example the position shown in FIG. 2, when the joystick 28 is moved out of its vertical position in a direction other than parallel to the longitudinal centerline L to thereby request a transverse movement of the marine vessel 10. In certain examples, the controller 14 can be configured such that once the marine propulsion devices 16*a*, 16*b* can moved into the unaligned position and operated to provide the thrusts necessary to achieve the requested transverse movement, the marine propulsion devices 16*a*, 16*b* remain in the unaligned position despite movement of the joystick 28 back into its vertical position. In certain examples, the marine propulsion devices 16*a*, 16*b* remain in the unaligned position simply as a result of the controller 14 not providing any further movement commands to the steering actuators 26*a*, 26*b*, even if the joystick 28 is returned to its vertical position, as shown in FIGS. 7-9. The system 12 can thus allows the user to input repetitive requests for transverse movement of the marine vessel 10 wherein the marine propulsion devices 16*a*, 16*b* do not return to the aligned position between such requests. This has been found to advantageously limit undesirable surge or backwards movement or rotation of the marine vessel 10. This example is particularly useful during docking procedures wherein the user repetitively taps the joystick 28 to request incremental transverse movements. Other similar control strategies are provided in U.S. Pat. No. 8,777,681, which is incorporated herein by reference.

The controller 14 can also be programmed such that further system requirements cause the marine propulsion devices 16*a*, 16*b* to move from an unaligned position to the aligned position shown in FIG. 1. For example, when the handle 48 of the joystick 28 is rotated to request rotational movement of the marine vessel 10, the controller 14 can be programmed to control movement of the marine propulsion devices 16*a*, 16*b* into the aligned position to achieve the requested rotational movement. In another example, the controller 14 can be programmed to control movement of the plurality of marine propulsion devices 16*a*, 16*b* into the aligned position when rotational movement of the vessel 10 is requested via rotation of the steering wheel 30. In a further example, the controller 14 can be programmed to control movement of the plurality of marine propulsion devices 16*a*, 16*b* into the aligned position upon operation of the shift/throttle lever 32.

The system 12 and related controller 14 can include override protocol for the above-described routines when various other system inputs are provided. For example, if the operator engages an autopilot program, a waypoint tracking or station keeping program, or an auto heading program, the above control routine can be overridden by the controller 14. In other examples, steering or engine faults that may influence thrust capabilities, multiple steering or engine faults that may influence thrust capabilities, emergency stop on one or more of the marine propulsion devices 16*a*, 16*b*, or key cycle events could override the above-described strategy.

Through research and experimentation, the present inventors have determined that certain prior art marine vessel and propulsion device configurations can achieve only a limited range of maneuverability of a marine vessel. This typically is because the steering capabilities of the propulsion devices are limited, particularly towards the inward direction (e.g. past the orientation shown in FIG. 2). This limitation on steering capability of the marine propulsion devices can be caused by the particular configuration of the propulsion device, the close proximity of adjacent propulsion devices and structures, and/or the particular configuration of the transom portion of the marine vessel. This limitation on steering capability decreases the maneuvering capability of the above control systems. More specifically, in order to lead the bow of the marine vessel during sidle translation, the controller is configured to steer the marine propulsion devices into an unaligned position wherein the marine propulsion devices produce thrusts that extend along propulsion axes that intersect aftwardly of the center of turn (i.e. aftwardly of the orientation shown in FIG. 2). However, due to the above-noted limitations on steering capability, on certain marine vessels it often is not possible to achieve the necessary outboard steering angle. For example, the present inventors have found these limitations in single and multi-hull/sponson boats with two or more engines. The inventors have found this to especially be the case in marine vessel configurations where the center of turn is located relatively close to the transom of the marine vessel.

The present inventors have endeavored to overcome these limitations in the prior art. FIGS. 1-6 depict an example according to the present disclosure wherein the marine vessel 10 has an elongated hull 60 that extends along the centerline L from an aftward end 62 to a forward end (schematically represented by arrow 64). Elongated first and second pontoons 66*a*, 66*b* support the hull 60 and each extend parallel to the centerline L and are disposed on opposite sides the centerline L, respectively. The first pontoon has a first transom portion 68*a*. The second pontoon has a second transom portion 68*b*. The first and second transom portions 68*a*, 68*b* each are located closer to the aftward end 62 than the forward end 64. Each transom portion 68*a*, 68*b* has a planar mounting face 69 configured to support the first and second marine propulsion devices 16*a*, 16*b*, respectively, which in this example are outboard motors. The first propulsion device 16*a* is connected to the mounting face 69 of the first transom 68*a* and steerable about the steering axis 34*a* which extends perpendicular to the centerline L. The second propulsion device 16*b* is connected to the mounting face 69 of the second transom 68*b* and steerable about the steering axis 34*b*, which extends perpendicular to the centerline L. The first and second transoms 68*a*, 68*b* each have an inboard side 70 and an outboard side 72. The inboard side 70 is located closer to the centerline L than the outboard side 72.

As shown in FIGS. 1 and 2, the first and second transoms 68*a*, 68*b* each are set at a non-perpendicular outboard angle α to the centerline L. The amount of the outboard angle α can vary. In certain examples, the outboard angle is 10 degrees. In certain other examples the outboard angle is greater than 10 degrees. As a result of the outboard angle α at which the transoms 68*a*, 68*b* are mounted, the inboard side 70 is located further from the forward end 64 than the outboard side 72. As shown in FIGS. 1 and 2, the first and second steering axes 34*a*, 34*b* each are located closer to the inboard side 70 than the outboard side 72 of the respective transom 68*a*, 68*b*.

The present inventors have found that mounting the marine propulsion devices 16*a*, 16*b* closer to the inboard side 70 of the transom 68*a*, 68*b*, which is set at the outboard angle α, greatly increases the maneuvering capabilities and effectiveness of the system 12. More specifically, when lateral movement of the marine vessel 10 is requested via the input device (e.g. joystick 28), the controller 14 normally is configured to steer each of the first and second propulsion devices 16*a*, 16*b* so as to direct thrusts inwardly along propulsion axes 36*a*, 36*b* that intersect at the center of turn 40 of the marine vessel 10. If the operator requests the bow to lead in the direction of lateral movement, or if external forces on the marine vessel 10 counteract the requested lateral movement, the system according to the present disclosure can provide increased steering angle capabilities inwardly. In other words, the available steering angle of the marine propulsion devices 16*a*, 16*b* towards the outboard side of the marine vessel 10 is greater than that of the prior art because the transoms 68*a*, 68*b* are mounted at the outboard angle α with respect to the marine vessel 10. The marine propulsion devices 16*a*, 16*b* are able to provide thrust along propulsion axes 36*a*, 36*b* that intersect each other at a location that is further aftwardly of the center of turn 40 than the prior art. The fact that the marine propulsion devices 16*a*, 16*b* are mounted closer to the inboard side 70 than the outboard side 72, further increases this capability. The present disclosure thus provides propulsion systems for marine vessels having an increased effective (available) inward steering angle which allows more movement capabilities of the marine vessel 10 to the port or starboard sides.

Figure 4:
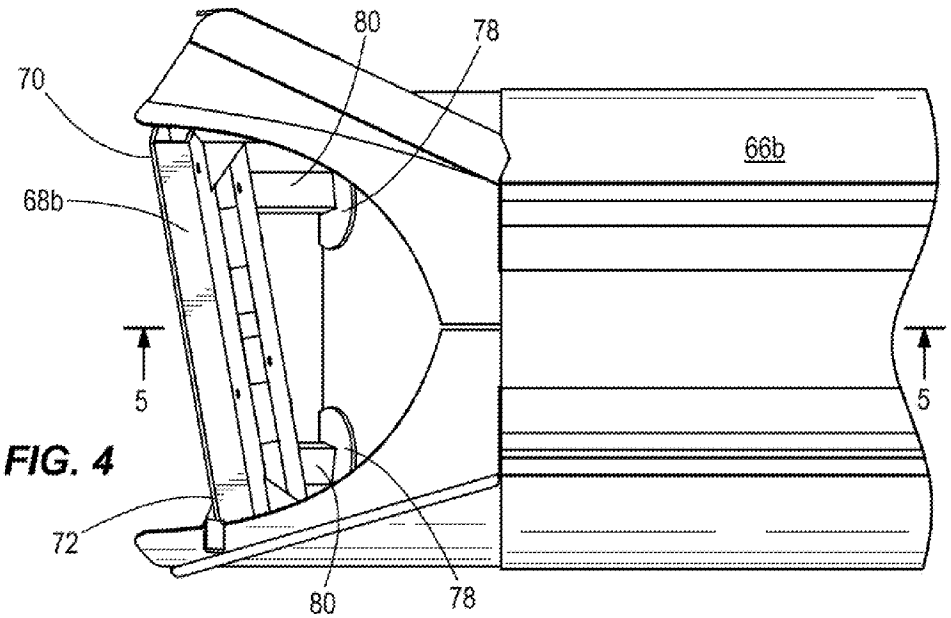
FIG. 4 is a top view of the aftward end of the starboard pontoon.
Figure 5:
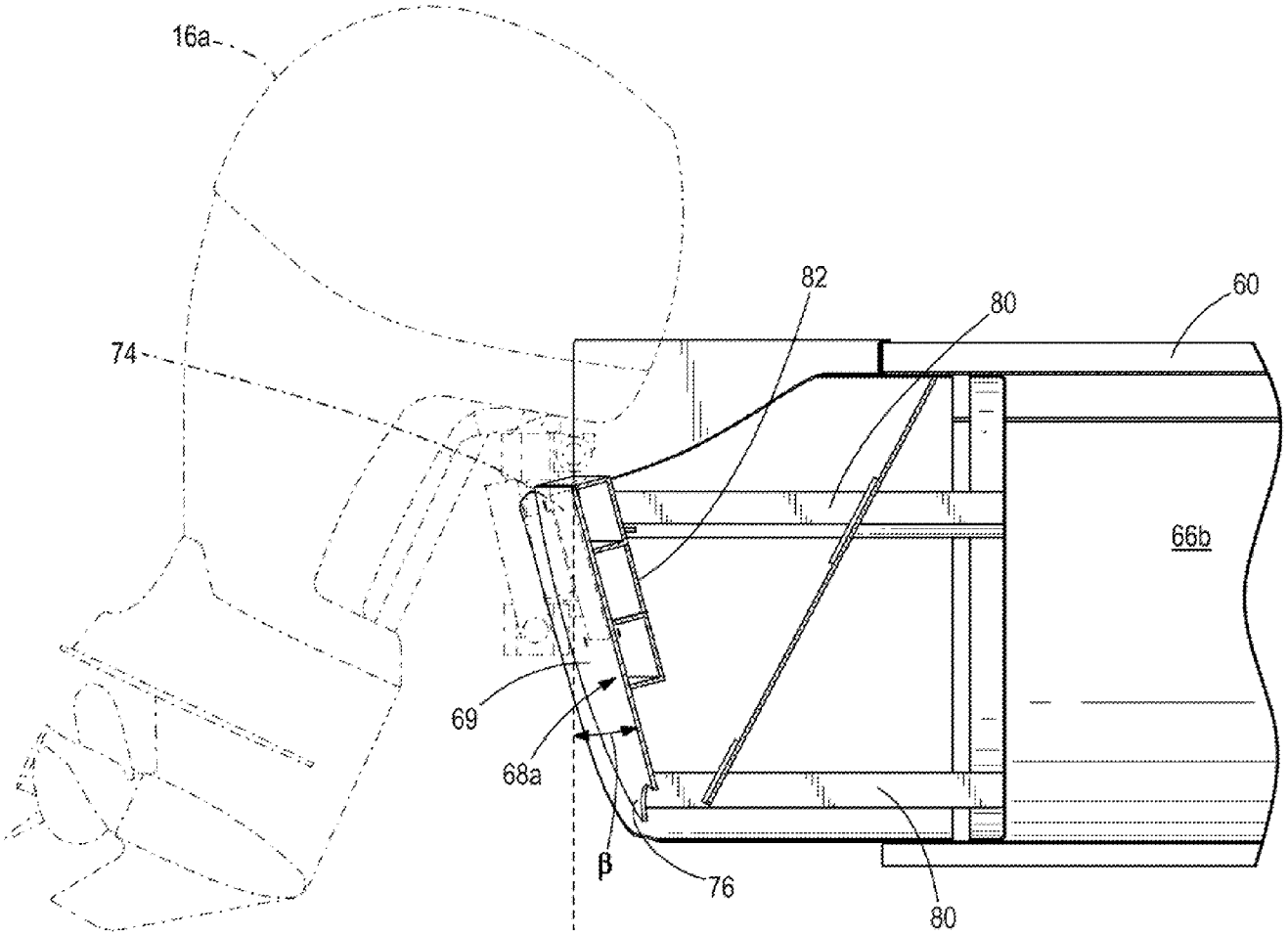
FIG. 5 is a side sectional view of the aftward end of the marine vessel.
Figure 6:
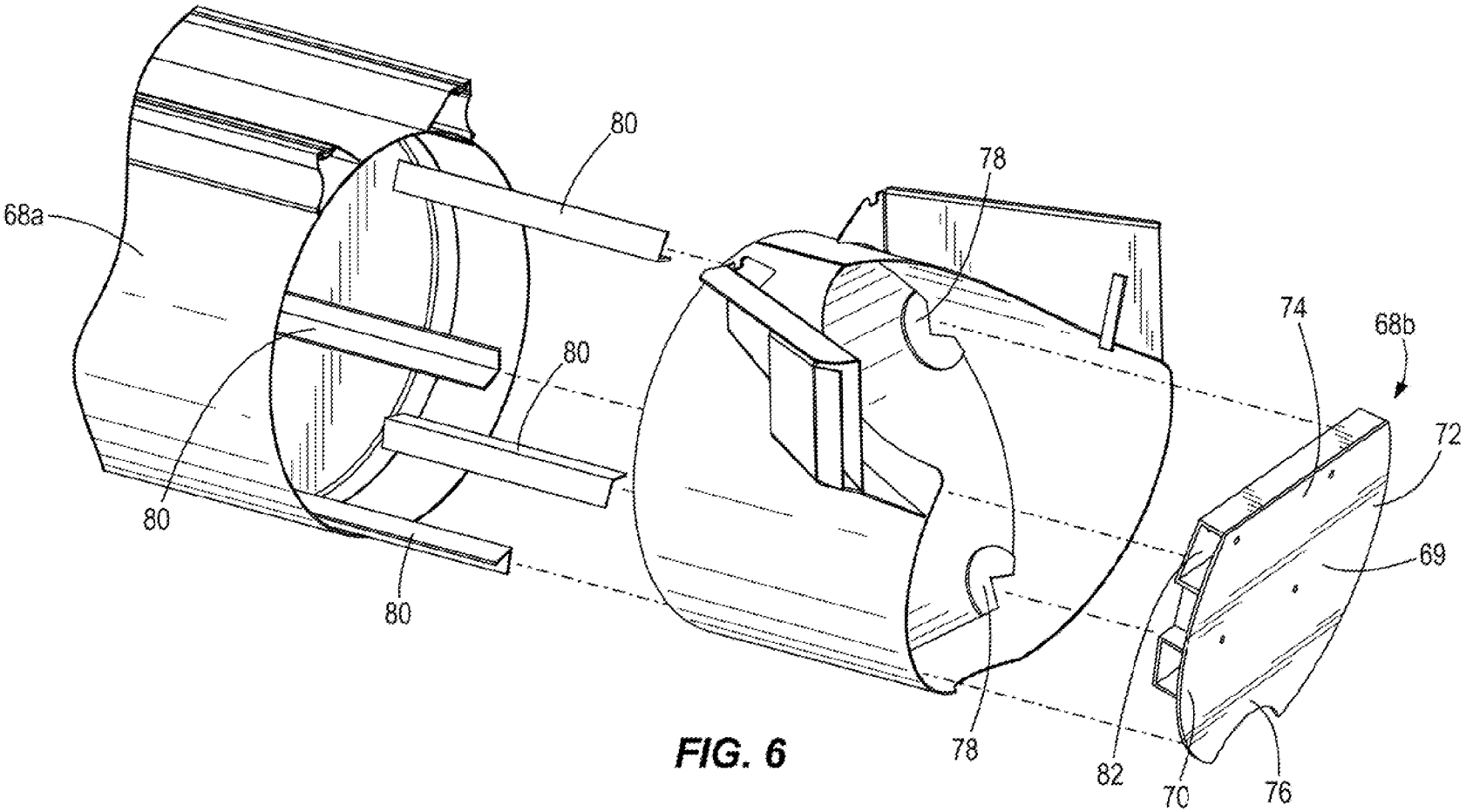
FIG. 6 is an exploded view of the aftward end of the pontoon.

In this particular example, the transoms 68*a*, 68*b* are also set at a vertical angle β (see FIG. 5) to facilitate trim of the marine propulsion devices 16*a*, 16*b*. The first and second transoms 68*a*, 68*b* each have a top side 74 and a bottom side 76. As shown in FIGS. 4 and 5, the first and second transoms 68*a*, 68*b* each are set at a vertical angle β to the centerline L such that the bottom side 76 is closer to the forward end 64 than the top side 74. In certain examples, the vertical angle β is 13 degrees. In certain other examples, the vertical angle β is at least 13 degrees.

The manner in which the transoms 68*a*, 68*b* are mounted to the hull/pontoons can vary. In this particular example, the transoms 68*a*, 68*b* are mounted to backing members 78 that extend into the interior of the respective pontoon 66*a*, 66*b*. Gusset members 80 are fastened to the pontoon 66*a*, 66*b* and provide support for the backing members 78. The transoms 68*a*, 68, have a reinforcement framework 82. Again, the particular mounting configuration can vary from that which is shown. Also, in the examples shown, the transom itself is set at the outboard angle. However in other examples, an additional wedge could be disposed between the propulsion device and a transom that is set perpendicular to the centerline L of the marine vessel to thereby obtain the noted outboard angle.

In the present description, certain terms have been used for brevity, clearness, and understanding. No unnecessary limitations are to be inferred therefrom beyond the requirement of the prior art because such terms are used for descriptive purposes only and are intended to be broadly construed. The different apparatuses described herein may be used alone or in combination with other apparatuses. Various equivalents, alternatives, and modifications are possible within the scope of the appended claims.

What is claimed is:

1. A marine vessel comprising:

an elongated hull that extends along a center axis from an aftward end to a forward end;

a first transom portion and a second transom portion, wherein each of the first and second transom portions are located closer to the aftward end than the forward end;

a first propulsion device that is connected to the first transom portion and steerable about a first steering axis;

a second propulsion device that is connected to the second transom portion and steerable about a second steering axis;

wherein the first and second transom portions have a mounting face that is set at a non-perpendicular outboard angle to the center axis; and a controller that is configured to steer the first and second propulsion devices inwardly towards a center of turn of the marine vessel so that during any lateral translations of the marine vessel the first and second propulsion devices can provide thrusts along axes that intersect aftwardly of the center of turn;

wherein the mounting face of each of the first and second transom portions have an inboard side and an outboard side, and wherein the inboard side is located closer to the center axis than the outboard side; and wherein the inboard side is located further from the forward end than the outboard side.

2. The marine vessel according to claim 1, wherein the first and second steering axes of the first and second propulsion devices each are closer to the inboard side than the outboard side of the first and second transom portion, respectively.

3. The marine vessel according to claim 1, wherein the outboard angle is 10 degrees from perpendicular.

4. The marine vessel according to claim 1, wherein the outboard angle is at least 10 degrees from perpendicular.

5. The marine vessel according to claim 1, wherein the mounting face of each of the first and second transom portions has a top side and a bottom side, and wherein the mounting face of the first and second transom portions is set at a vertical angle to the center axis such that the bottom side is closer to the forward end than the top side.

6. The marine vessel according to claim 5, wherein the vertical angle is 13 degrees.

7. The marine vessel according to claim 5, wherein the vertical angle is at least 13 degrees.

8. The marine vessel according to claim 1, comprising a joystick configured to input control signals to the controller.

9. The marine vessel according to claim 8, wherein the marine vessel comprises a pontoon boat and wherein the first and second transom portions are disposed on first and second pontoons.

10. A pontoon boat comprising:

an elongated hull that extends along a center axis from an aftward end to a forward end;

elongated first and second pontoons that each extend parallel to the center axis and are disposed on opposite sides the center axis, respectively;

wherein the first pontoon has a first transom, wherein the second pontoon has a second transom, and wherein the first and second transoms each are located closer to the aftward end than the forward end;

a first propulsion device that is connected to the first transom and steerable about a steering axis that is perpendicular to the center axis;

a second propulsion device that is connected to the second transom and steerable about a steering axis that is perpendicular to the center axis;

wherein the first and second transoms each have a mounting face that is set at a non-perpendicular outboard angle to the center axis; and a controller that is configured to steer each of the first and second propulsion devices inwardly towards a center of turn of the pontoon boat during lateral translation of the pontoon boat so that during lateral translations of the pontoon boat the first and second propulsion devices can provide thrusts along axes that intersect aftwardly the center of turn;

wherein the mounting face of each of the first and second transoms has an inboard side and an outboard side, and wherein the inboard side is located closer to the center axis than the outboard side; and wherein the inboard side is located further from the forward end than the outboard side.

11. The pontoon boat according to claim 10, wherein the steering axes of the first and second propulsion devices are closer to the inboard side than the outboard side of the first and second transom portion, respectively.

12. The pontoon boat according to claim 10, wherein the outboard angle is 10 degrees from perpendicular.

13. The pontoon boat according to claim 12, wherein the outboard angle is at least 10 degrees from perpendicular.

14. The pontoon boat according to claim 10, wherein the mounting face of each of the first and second transom has a top side and a bottom side, and wherein the first and second transoms are further set at a vertical angle to the center axis such that the bottom side is closer to the forward end than the top side.

15. The pontoon boat according to claim 14, wherein the vertical angle is 13 degrees.

16. The pontoon boat according to claim 14, wherein the vertical angle is at least 13 degrees.

17. The pontoon boat according to claim 10, comprising a joystick configured to input control signals to the controller.

18. The pontoon boat according to claim 17, wherein the controller is configured to orient the propulsion devices inwardly towards a center of pressure of the marine vessel when lateral translation is requested of the marine vessel via the joystick.

* * * * *